US011802481B2

(12) United States Patent
Lu

(10) Patent No.: US 11,802,481 B2
(45) Date of Patent: Oct. 31, 2023

(54) DISK CUTTER

(71) Applicant: ELEMENT SIX (UK) LIMITED, Didcot (GB)

(72) Inventor: Shuo Lu, Didcot (GB)

(73) Assignee: Element Six (UK) Limited, Didcot (GB)

( * ) Notice: Subject to any disclaimer, the term of this patent is extended or adjusted under 35 U.S.C. 154(b) by 0 days.

(21) Appl. No.: 17/770,830

(22) PCT Filed: Nov. 25, 2020

(86) PCT No.: PCT/EP2020/083296

§ 371 (c)(1),
(2) Date: Apr. 21, 2022

(87) PCT Pub. No.: WO2021/110500

PCT Pub. Date: Jun. 10, 2021

(65) Prior Publication Data

US 2022/0372874 A1 Nov. 24, 2022

(30) Foreign Application Priority Data

Dec. 4, 2019 (GB) ..... 1917708
Apr. 6, 2020 (GB) ..... 2005020

(51) Int. Cl.
*E21C 25/18* (2006.01)
*E02F 3/24* (2006.01)
*E02F 5/08* (2006.01)

(52) U.S. Cl.
CPC ..... *E21C 25/18* (2013.01); *E02F 3/241* (2013.01); *E02F 5/08* (2013.01)

(58) Field of Classification Search
CPC ..... E21C 25/18; E02F 3/241; E02F 5/08
See application file for complete search history.

(56) References Cited

U.S. PATENT DOCUMENTS

| | | | |
|---|---|---|---|
| 3,544,166 | A | 12/1970 | Proctor |
| 4,216,832 | A | 8/1980 | Stephenson et al. |
| 2011/0016754 | A1 | 1/2011 | Ruhl et al. |
| 2014/0013634 | A1 | 1/2014 | Huber |

(Continued)

FOREIGN PATENT DOCUMENTS

| | | | |
|---|---|---|---|
| CN | 110258697 | A | 9/2019 |
| GB | 2572263 | A | 9/2019 |

(Continued)

OTHER PUBLICATIONS

United Kingdom Patent Application No. GB1917708.8, Combined Search and Examination Report dated Sep. 16, 2020, 12 pages.

(Continued)

*Primary Examiner* — Janine M Kreck
(74) *Attorney, Agent, or Firm* — Kilpatrick Townsend & Stockton LLP

(57) ABSTRACT

This disclosure relates to a disk cutter (18) comprising a cutter body, a plurality of tool holders (24) and a plurality of cutting elements (22) mounted to the tool holders. The tool holders and cutting elements are provided in at least one set about the cutter body, each set comprising two or more tool holders and two or more cutting elements arranged in a p re-determined sequence of configurations.

18 Claims, 10 Drawing Sheets

(56) References Cited

U.S. PATENT DOCUMENTS

| | | | | |
|---|---|---|---|---|
| 2014/0175853 | A1* | 6/2014 | Warren | E21C 35/183 299/101 |
| 2014/0339883 | A1 | 11/2014 | Burton et al. | |
| 2016/0263774 | A1 | 9/2016 | Runquist et al. | |

FOREIGN PATENT DOCUMENTS

| | | | |
|---|---|---|---|
| JP | 4319195 | A | 10/1992 |
| KR | 20190100604 | A | 8/2019 |
| WO | 2013092346 | A2 | 6/2013 |
| WO | 2014049162 | A2 | 4/2014 |
| WO | 2018055543 | A1 | 3/2018 |
| WO | 2019180164 | A1 | 9/2019 |
| WO | 2019180169 | A1 | 9/2019 |
| WO | 2019180170 | A1 | 9/2019 |

OTHER PUBLICATIONS

United Kingdom Patent Application No. GB2005020.9, Combined Search and Examination Report dated Aug. 25, 2020, 7 pages.
United Kingdom Patent Application No. GB2018494.1, Combined Search and Examination Report dated Jan. 20, 2021, 8 pages.
International Patent Application No. PCT/EP2020/083296, International Search Report and Written Opinion dated Feb. 9, 2021, 16 pages.
International Patent Application No. PCT/EP2020/083296, International Preliminary Report on Patentability dated Feb. 25, 2022, 29 pages.
Japanese Patent Application No. 2022-533483, Notice of Reasons for Refusal (Office Action) dated May 25, 2023, 11 pages.

* cited by examiner

DISK CUTTER

FIELD OF THE INVENTION

The present disclosure relates to a disk cutter used in mining and excavation machines or in trenching machines. In particular, it relates to a disk cutter with cutting elements comprising superhard materials, such as polycrystalline diamond.

BACKGROUND

Many types of rock formations are available around the world as large deposits, commonly known as slabs. Various types of mining equipment are deployed in above ground quarries in order to extract the slabs from the ground. The slabs are retrieved using specialist equipment, typically dragged from their resting place by large and very powerful vehicles. Rock slabs may weigh up to 40 tons (40,000 kg). Processing, such as polishing, may take place on site, or alternatively the slabs may be transported off site for cutting into appropriately sized pieces for domestic and industrial use.

The same equipment used above ground may not always be directly usable within the confined space of a subterranean mine.

It is an object of the invention to provide a compact and versatile cutting assembly to facilitate the mining and extraction of geometrically or non-geometrically shaped blocks of specific rock formations, and one that may be used above or below ground.

The Applicant's co-pending applications WO 2019/180164 A1, WO 2019/180169 A1, WO 2019/180170 A1 disclose a cutting assembly comprising a circular disk cutter, which is moveable between horizontal and vertical cutting orientations. Cylindrical cutting elements and a corresponding quantity of tool holders are arranged and seated around a circumferential surface of the disk cutter. Each tool holder is at least partially laterally offset with respect to the circular body. The disadvantage of such an arrangement is that it still requires substantial cutting forces in order to cut through rock formations.

It is an object of the invention to provide a cutting assembly with reduced cutting forces.

SUMMARY OF THE INVENTION

According to a first aspect of the invention, there is provided a disk cutter comprising a cutter body, a plurality of tool holders and a plurality of cutting elements mounted to the tool holders, wherein the tool holders and cutting elements are provided in at least one set about the cutter body, each set comprising two or more tool holders and two or more cutting elements, the two or more cutting elements being arranged in a pre-determined sequence of configurations on the tool holders, the tool holders all facing in the same direction.

The disk cutter may comprise multiple sets around a circumferential surface of the cutter body.

The multiple sets may be identical. Alternatively, the multiple sets may be non-identical.

The disk cutter may comprise three or more tool holders in a set.

The disk cutter may comprise four tool holders in a set.

The disk cutter may comprise a single cutting element in one or more of the tool holders. In this embodiment, the single cutting element is optionally mounted centrally on the tool holder.

The disk cutter may comprise two cutting elements in one or more of the tool holders. In such an embodiment, the two cutting elements may be arranged side-by-side adjacent to each other on the tool holder. Alternatively, the two cutting elements may be arranged spaced apart from each other on the tool holder. Optionally, the two cutting elements are arranged spaced apart with a recessed channel in between then.

The cutting element may be a polycrystalline diamond compact (PDC). Optionally, the PDC has a triple chamfer.

Preferably, the tool holder comprises a body portion and a pair of spaced apart legs. The tool holder optionally tapers inwardly from a first end, proximate the or each cutting element, towards a second end.

The cutter body may comprise a series of slots.

According to a second aspect of the invention, there is provided a trench cutter comprising a disk cutter in accordance with the first aspect. Optionally, the cutter body has a diameter in the range of 900 to 1200 mm. Preferably, the cutter body has a thickness in the range of 20 to 30 mm. Preferably, the disk cutter has an effective cutting width of around 60 mm.

According to a third aspect of the invention, there is provided a disk cutter comprising a cutter body, a plurality of tool holders, a plurality of cutting elements, at least one cutting element mounted to at least one tool holder, the plurality of tool holders and plurality of cutting elements being provided along a peripheral surface of the cutter body, the tool holders and cutting elements provided in at least one set about the cutter body, each set comprising two or more tool holders and two or more cutting elements arranged in a pre-determined sequence of configurations, wherein the cutter body comprises at least one light-weighting aperture.

The disk cutter comprise multiple sets around a peripheral surface of the cutter body.

The multiple sets may be identical. Alternatively, the multiple sets may be non-identical.

The disk cutter may comprise three or more tool holders in a set.

The disk cutter may comprise four tool holders in a set.

The disk cutter may comprise a single cutting element in one or more of the tool holders. In this embodiment, the single cutting element is optionally mounted centrally on the tool holder.

The disk cutter may comprise two cutting elements in one or more of the tool holders. In such an embodiment, the two cutting elements may be arranged side-by-side adjacent to each other on the tool holder. Alternatively, the two cutting elements may be arranged spaced apart from each other on the tool holder. Optionally, the two cutting elements are arranged spaced apart with a recessed channel in between then.

The cutting element may be a polycrystalline diamond compact (PDC). Optionally, the PDC has a triple chamfer.

Preferably, the tool holder comprises a body portion and a pair of spaced apart legs. The tool holder optionally tapers inwardly from a first end, proximate the or each cutting element, towards a second end.

BRIEF DESCRIPTION OF THE DRAWINGS

The invention will now be more particularly described, by way of example only, with reference to the accompanying drawings, in which.

In the drawings, similar parts have been assigned similar reference numerals.

DETAILED DESCRIPTION

Figure 1:
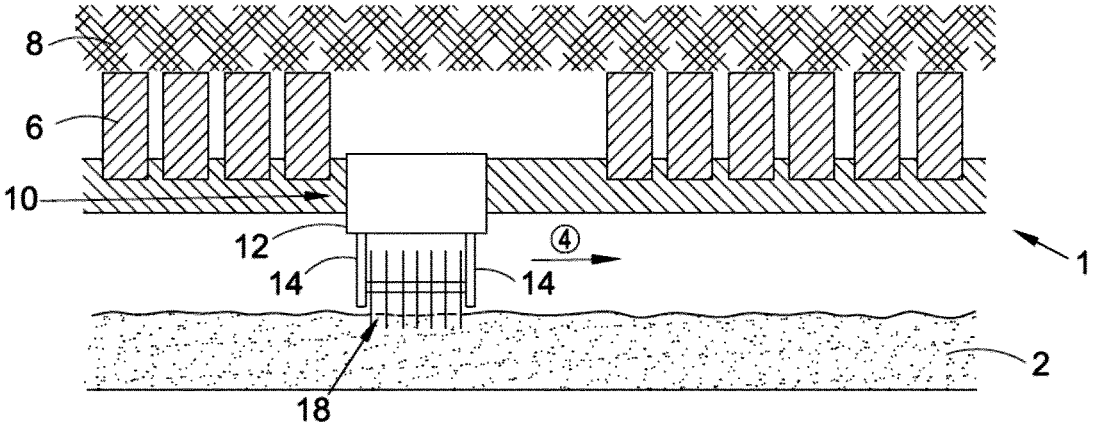
FIG. 1 is a schematic plan view of an underground mine incorporating a first embodiment of a cutting assembly as part of a long wall mining system, and in particular shows the cutting assembly in a horizontal orientation.
Figure 2:
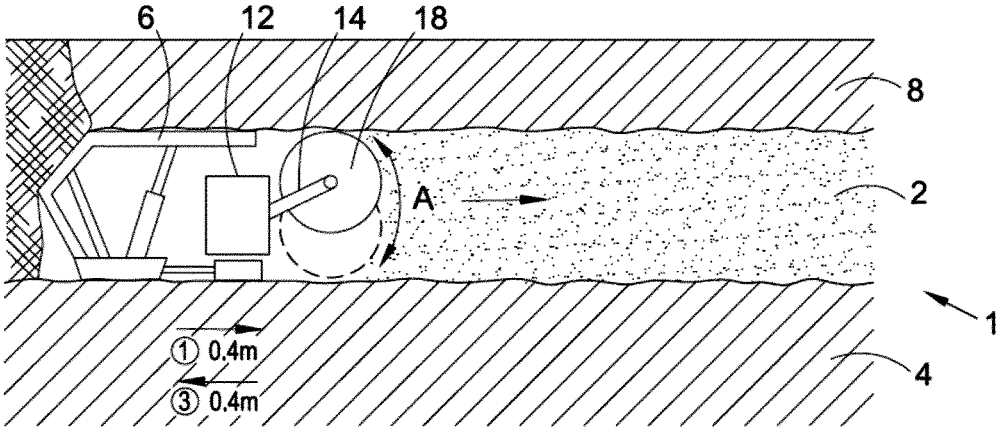
FIG. 2 is a schematic end view of the long wall mining system of FIG. 1.

Referring initially to FIGS. 1 to 2, a cutting assembly for slicing into natural formations 2 underground is indicated generally at 10.

The cutting assembly forms part of a long wall mining system 1, commonly found in underground mines. The cutting assembly is a substitute for known shearer technology, which operates on a mine floor 4, amidst a series of adjustable roof supports 6. As the shearer advances in the direction of mining, the roof supports 6 are positioned to uphold the mine roof 8 directly behind the shearer. Behind the roof supports 6, the mine roof 6 collapses in a relatively controlled manner. Typically, a gathering arm collects mined rock at the cutting face and transfers it onto a conveying system for subsequent removal from the mine.

As indicated in FIGS. 1 and 2, the cutting assembly 10 comprises a base unit 12, a pair of spaced apart support arms 14 extending from the base unit 12, a drive spindle 16 extending between and rotatably mounted to the pair of moveable support arms 14, and a plurality of disk cutters 18 fixed about the drive spindle 16.

Figure 3:
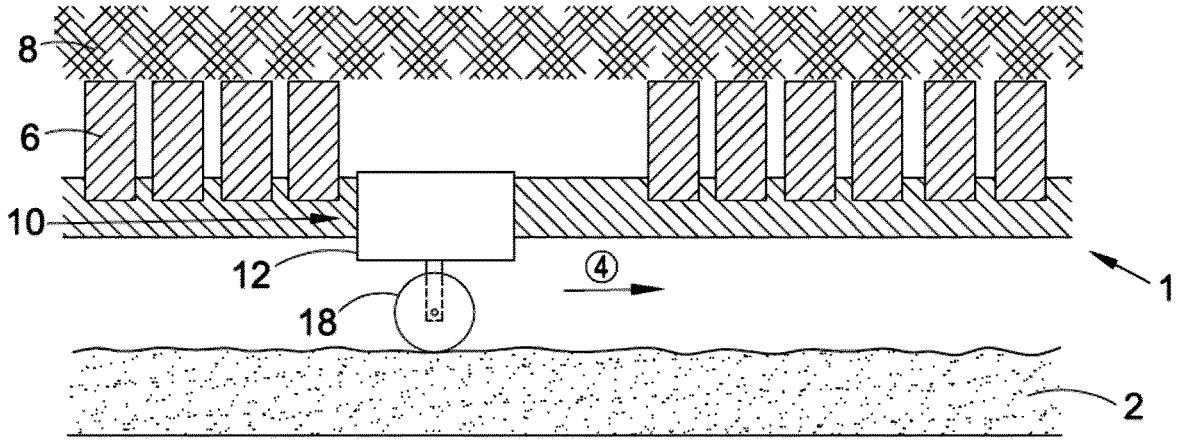
FIG. 3 is a schematic plan view of an underground mine incorporating a second embodiment of a cutting assembly as part of a long wall mining system, and in particular shows the cutting assembly in a vertical orientation.
Figure 4:
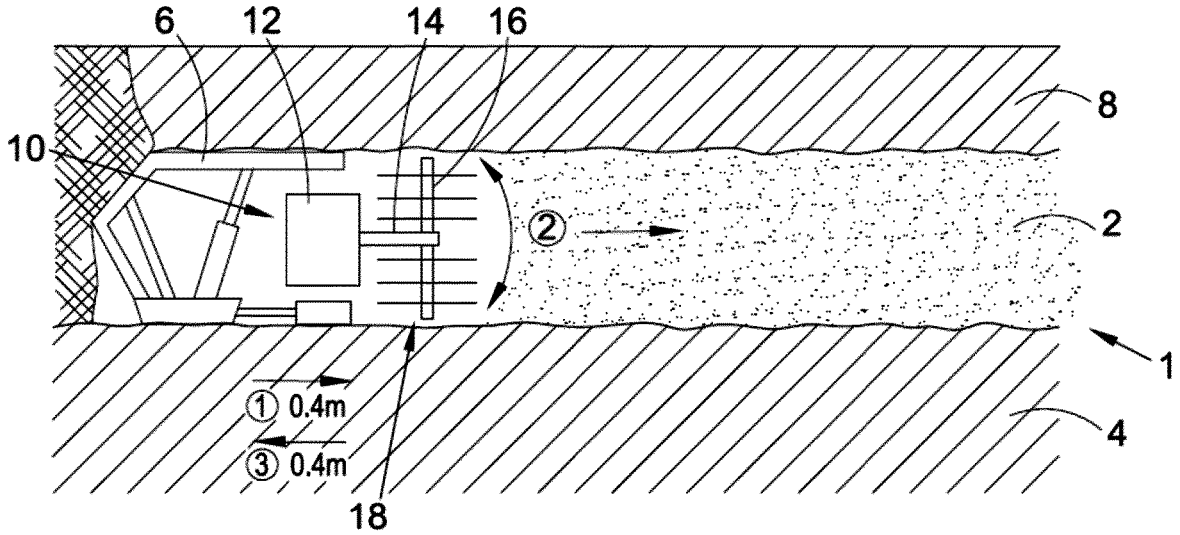
FIG. 4 is schematic end view of the long wall mining system of FIG. 3.

In a second embodiment, indicated in FIGS. 3 and 4, a single support arm 14 extends from the base unit 12. The drive spindle 16 is supported centrally by the single support arm 14, and the plurality of disk cutters 18 is mounted to the drive spindle 16, distributed either side of the single support arm 14.

In an alternative embodiment, not shown, only a single disk cutter 18 is used.

Preferably, the or each disk cutter 18 is mounted at is centre (i.e. centrally) about the drive spindle 16. However, this is not essential, and the or each disk cutter 18 may alternatively be mounted off-set from its centre about the drive spindle 16. Optionally, a combination of the two arrangements could be used instead. For example, when multiple disk cutters 18 are used in a series, i.e. in parallel next to each other along a drive spindle 16, alternating disk cutters 18 may be mounted centrally about the drive spindle 16. Each centre of the remaining disk cutters 18 may be radially off-set from the point at which the disk cutter 18 is mounted about the drive spindle 16. Other combinations are envisaged.

The base unit 12 functions as a transport system for the disk cutter 18. The base unit 12 is moveable to advance and retract the disk cutter 18 into and out of an operational position, in close proximity to the rock formation 2 to be cut. The speed at which the base unit 12 moves closer to the rock formation 2 is one of several variables determining the feed rate of the cutting assembly 10 into the rock formation 2. The base unit 12 (in concert with the roof supports 6) is also moveable sideways, from left to right and vice versa, along the long wall of the rock formation 2 to be mined.

Each support arm 14 is configured to be moveable into a first and a second cutting orientation. In the first cutting orientation, best seen in FIGS. 1 and 2, the drive spindle 16 is horizontal. As a result, cuts in the rock formation 2 made by the disk cutter 18 are correspondingly vertical. In the second cutting orientation, best seen in FIGS. 3 and 4, the drive spindle 16 is vertical. Consequently, cuts in the rock formation 2 made by the disk cutter 18 are correspondingly horizontal. First and second cutting orientations are possible with either first or second embodiments mentioned above.

Optionally, the support arm(s) 14 may also be moveable such that the drive spindle 16 is operable in any cutting orientation between the aforementioned vertical and horizontal, though this is not essential. The support arm(s) 14 may alternatively be configured such that they are moveable between the first and second cutting orientations but only fully operational (i.e. the disk cutter(s) to rotate in order to facilitate cutting or pulverising of the rock) in the first and second cutting orientations.

Each support arm 14 is moveable between a first operative position and a second operative position, in optionally each of the first and second cutting orientations, according to the depth of cut required. This is indicated by double end arrow A in FIG. 2. For example, in the first operative position, the drive spindle 16 is lowered so as to be in close proximity to the mine floor 4 and in the second operative position, the drive spindle 16 is raised so as to be in close proximity to the mine roof 8.

Optionally, each support arm 14 may have a first arm portion connected to a second arm portion by a pivot joint (or alternatively, a universal joint), each first and second arm portion being independently moveable relative to each other. This arrangement augments the degrees of freedom with which the cutting assembly 10 may operate and advantageously improves its manoeuvrability.

The drive spindle 16 is driven by a motor to rotate at a particular speed. The power of the motor is typically between 20 and 50 kW per disk cutter 18, depending on the type of disk cutter 18 selected and the cutting force required.

Figure 5:
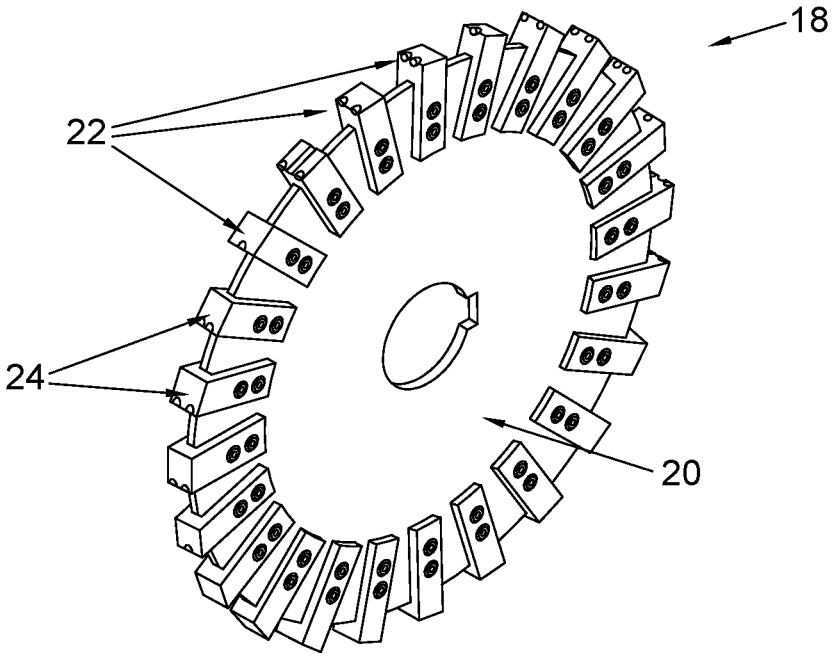
FIG. 5 is a perspective view of a disk cutter in a first embodiment of the invention.

Turning now to FIG. 5, in an embodiment of the invention, the disk cutter 18 comprises a generally circular body 20 and a plurality of cutting elements 22 arranged peripherally around the circular body 20. Rotation of the drive spindle 16 causes a corresponding rotation of the disk cutter 18. The disk cutter 18 need not be generally circular, for example, depending on its size, an octagonal shaped cutter could approximate a generally circular disk cutter. Accordingly, the disk cutter 18 may be hexagonal, octagonal, decagonal etc, or indeed have any number of circumferentially extending sides. More information about the body 20 is provided further below.

In a preferred embodiment, a plurality of disk cutters 18 is arranged on the drive spindle 16. Typically, six or more disk cutters 18 may be provided. The disk cutters 18 are preferably regularly spaced apart along the length of the drive spindle 16, between the pair of spaced apart support arms 14, or either side of the support arm 14, depending on the embodiment.

The spacing of the disk cutters 18 is selected according to the depth of cut required and the mechanical properties, e.g. Ultimate Tensile Strength (UTS), of the rock formation 2 being cut in order to optimise the specific cutting energy, which will dictate the required power consumption. The aim is to achieve conditions under which the cut material will breakout under its own weight. For example, for a 0.4 m depth of cut in Kimberlite, the ideal spacing between adjacent disk cutters is around 0.3 m. However, this can be increased or decreased depending on the force required for breakout. Preferably, the spacing is adjustable in-situ and may be an automated process or a manual process. The spacing may be remotely adjustable, for example from an operations office above ground. A wedge shaped tool may be used to apply such a breakout force, to assist in rock breakout.

The disk cutters 18 are spaced apart by a gap measuring between preferably 0.01 m and 2 m, more preferably between 0.01 m and 0.5 m. Yet more preferably, the disk cutters are 18 spaced apart by a gap measuring between 10 cm and 40 cm.

The circular body 20 of the disk cutter 18 is typically made from steel and has a diameter of approximately 1000 mm and a thickness (measured axially, also considered to be a lateral extent for subsequent descriptions) of approximately 10 to 30 mm. Realistically, such a diameter enables a depth of cut of up to 400 mm. The circular body 20 has a shaft diameter of between 60 mm and 100 mm, and is sized and shaped to receive the drive spindle 16.

The diameter (or effective diameter in the case of non-circular disk cutters) and thickness of the disk cutter 18 are selected appropriately according to the intended application of the cutting assembly. For example, cable laying applications would require a disk cutter 18 with a smaller diameter. Robotic arm angle grinders would require a yet smaller diameter. Tunnelling applications though would require a disk cutter 18 with a significantly greater diameter and would be adapted accordingly.

According to the invention, the disk cutter 18 also comprises a plurality of tool holders 24 for each receiving at least one cutting element 22. In this embodiment, there is a repeating set of four tool holders 24 and seven cutting elements 22. There are forty-two PDC cutting elements 22 in total. Each set is repeated identically about the circular body 20. In each set, there are four different spatial configurations of tool holder 24 and cutting element 22, as explained in more detail below. When arranged in sequence, one behind the other in the direction of rotation of the disk cutter 18, the required cutting force of the disk cutter 18 is significantly reduced.

In each set, the tool holders remain facing the same forward direction, towards the direction of rotation. It is the arrangement of cutting elements that changes from one tool holder to the next within the set. It is the pre-determined sequence of cutting elements that is advantageous and distinct from the prior art.

Non-identical sets located about the circular body 20 may be used.

Not all sets have to include tool holders with any cutting elements. They could simply be 'blanks' without cutting elements.

Figure 6:
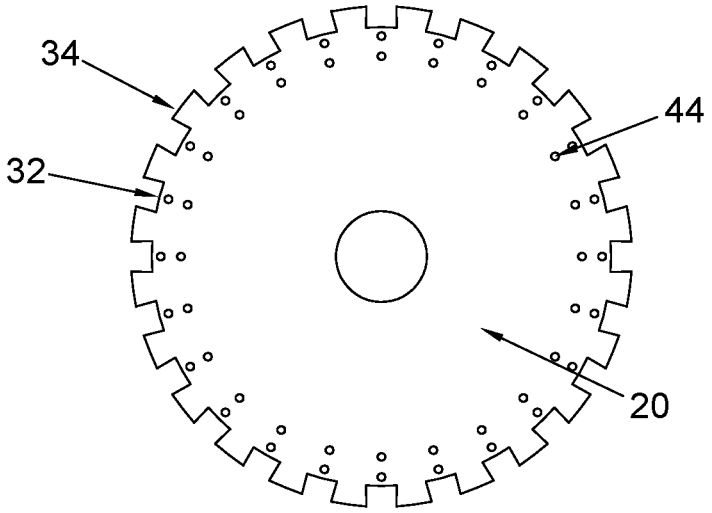
FIG. 6 is a side view of a first embodiment of a cutter body forming part of the disk cutter of FIG. 5.

Each tool holder 24 comprises a body portion 26 and a pair of spaced apart legs 28 extending from the body portion 26. The body portion 26 is generally cuboidal. The body portion 26 hosts the or each cutting element 22. Each leg 28 of the pair of legs is plate-like. The legs 28 are spaced apart by a gap 30, which enables coupling of the tool holder 24 either side of the circular body 20. A plurality of slots 32 are positioned periodically along the circumferential surface 34 of the generally circular body 20, as shown in FIG. 6. Each slot 32 become occupied with said gap 30 when the tool holder 24 is mounted on the circular body 20. The slots 32 reduce the shear force on the bolts during use. By virtue of the circumferential surface 34 of the circular body 20 extending between neighbouring slots 32, tool holders 24 are regularly spaced apart around the circular body 20. In this embodiment, twenty four slots are provided for twenty-four tool holders 24.

The tool holder 24 tapers inwardly from a first end 36, proximate the or each cutting element 22, towards a second end 38, proximate a free end of each leg 28.

Figure 7:
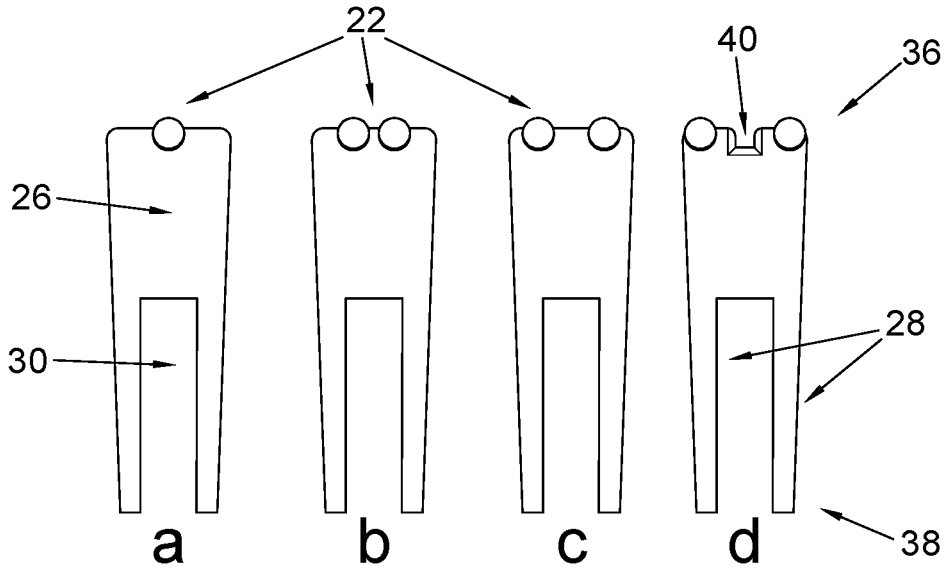
FIG. 7 is a front view of a set of tool holders and cutting elements forming part of the disk cutter of FIG. 5.

A first embodiment of the tool holder 24 is shown in FIG. 7*a*), which is configured to seat a single, (axially) centrally mounted, cutting element 22.

A second embodiment of the tool holder is shown in FIG. 7*b*, which is configured to seat two adjacent cutting elements 22.

A third embodiment of the tool holder 24 is shown in FIG. 7*c*), which is configured to seat two spaced apart cutting elements 22.

Figure 10:
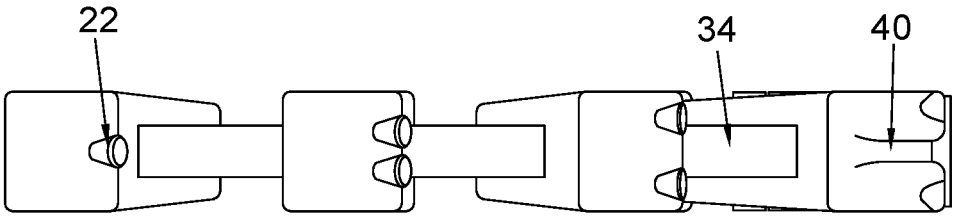
FIG. 10 is a top view of the disk cutter of FIG. 5.

A fourth embodiment of the tool holder 24 is shown in FIG. 7*d*), which is configured to seat two spaced apart cutting elements 22 with a central recessed channel 40 between the two cutting elements 22. The elongate channel 36 extends in the direction of intended rotation of the disk cutter 18—see FIG. 10.

Figure 8:
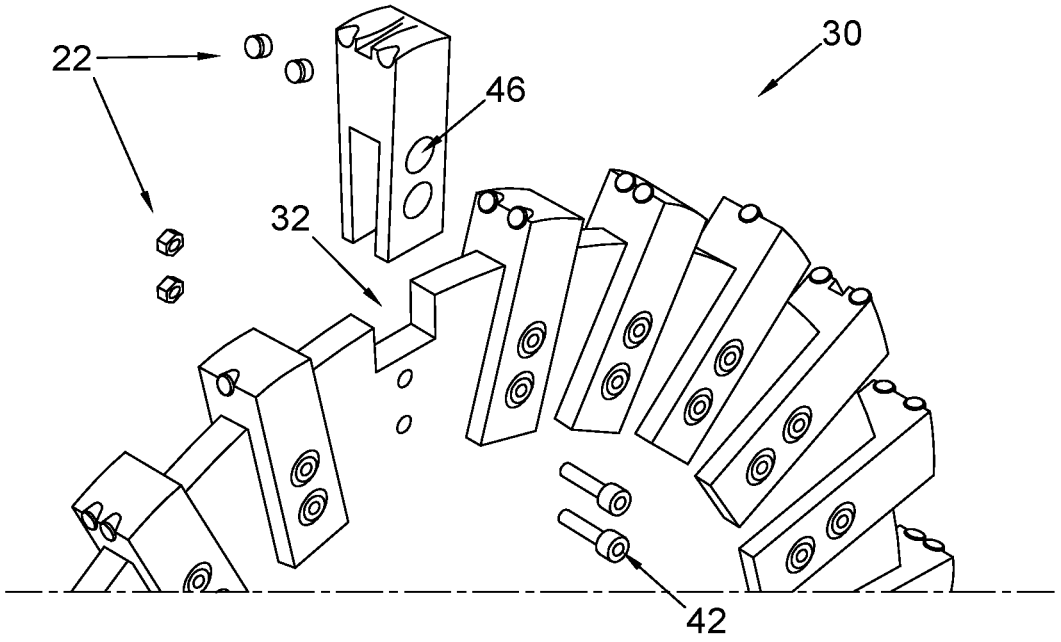
FIG. 8 is an exploded partial view of the disk cutter of FIG. 5.
Figure 9:
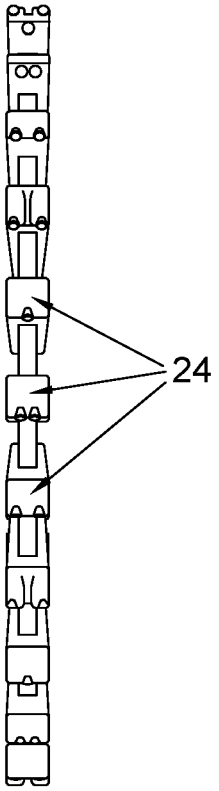
FIG. 9 is a front view of the disk cutter of FIG. 5.

Preferably, the tool holders are arranged in the following sequence: a), d), c), b), as shown in FIG. 8. However, any ordering within the sequence is envisaged provided that all four tool holder configurations are used. For example, see Table 1 below.

TABLE 1

| Position within sequence | | | |
|---|---|---|---|
| First | Second | Third | Fourth |
| a | b | c | d |
| a | b | d | c |
| a | c | b | d |
| a | c | d | b |
| a | d | b | c |

It is also feasible to use sets containing two, three or more configurations of tool holder(s) and cutting element(s). The size of each cutting element 22 and the spacing between the cutting elements, if more than one cutting element is used on a particular tool holder 24, will need to be adjusted accordingly.

Preferably, each tool holder 24 is made from steel but may alternatively comprise any metal(s) or carbides or ceramic based materials with a hardness above 70 HV (Vickers Hardness). Each tool holder 24 may be either permanently connected to the cutter body 20 (e.g. using brazing or welding), or, as in the embodiment shown in FIGS. 5 to 15, it is detachably mounted to the cutter body 20 using a retention mechanism, such as two pairs of nuts and bolts 42 in apertures 44 on the body 20 and apertures 46 in the legs 28. A mixture of brazing, welding and/or mechanical connections could be used. Alternatively, the tool holder(s) 24 may be formed integrally with the body 20 of the disk cutter 18, for example, by forging, powder metallurgy etc.

In one embodiment, each cutting element 22 is rigidly or fixedly supported by one of the tool holders 24. Each tool holder 24 is preferably equi-angularly spaced around a circumferential surface of the cutter body 20. Each cutting element 22 may be secured in place in or on the tool holder 24 using brazing. Alternatively, the or each tool holder 24 may be configured to rotatably receive a cutting element 22. In such an embodiment, the or each cutting element 22 and tool holder 24 may be configured such that the or each cutting element 22 may freely rotate within the tool holder 24, e.g. with a clearance fit, or alternatively be able to rotate within the tool holder 24 only when the cutting element 22 comes into contact with the rock formation being mined/excavated, e.g. with a transition fit.

Each of the cutting elements 22 comprise a hard, wear resistant material with a hardness value of 130 HV and above. The cutting element 22 preferably comprises a superhard material selected from the group consisting of cubic boron nitride, diamond, diamond like material, or combinations thereof, but may be a hard material such as tungsten carbide instead. The cutting element 22 may comprise a cemented carbide substrate to which the superhard material is joined.

In one embodiment, the cutting elements 22 are polycrystalline diamond compacts (PDCs), more commonly found in the field of Oil and Gas drilling. Such PDCs are often cylindrical and usually comprise a diamond layer sinter joined to a steel or carbide substrate.

The PDC has a diameter of between 6 mm and 30 mm, preferably between 8 mm and 25 mm. For example, the PDC may have a diameter of 6 mm, 11 mm, 12 mm, 13 mm, or 16 mm or 19 mm. A combination of diameters may be used in a disk cutter.

Figure 11:
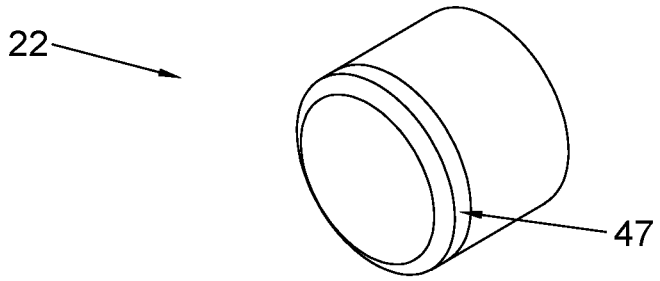
FIG. 11 is a perspective view of the cutting element of FIG. 5.

Each PDC may be chamfered, double chamfered or multiple chamfered; FIG. 11 depicts a PDC that is triple chamfered (indicated at 47) to reduce the risk of early failure of the cutting element 22.

Each PDC may comprise a polished cutter surface, or be at least partially polished.

Alternatively, rather than being a traditional PDC, the cutting element 22 may be a 3-D shaped cutter. A strike tip of the cutting element 22 may be conical, pyramidal, ballistic, chisel-shaped or hemi-spherical. The strike tip may be truncated with a planar apex, or non-truncated. The strike tip may be axisymmetric or asymmetric. Any shape of cutting element 22 could be used, in combination with any aspect of this invention. Examples of such shaped cutters can be found in WO 2014/049162 and WO 2013/092346.

Figure 12:
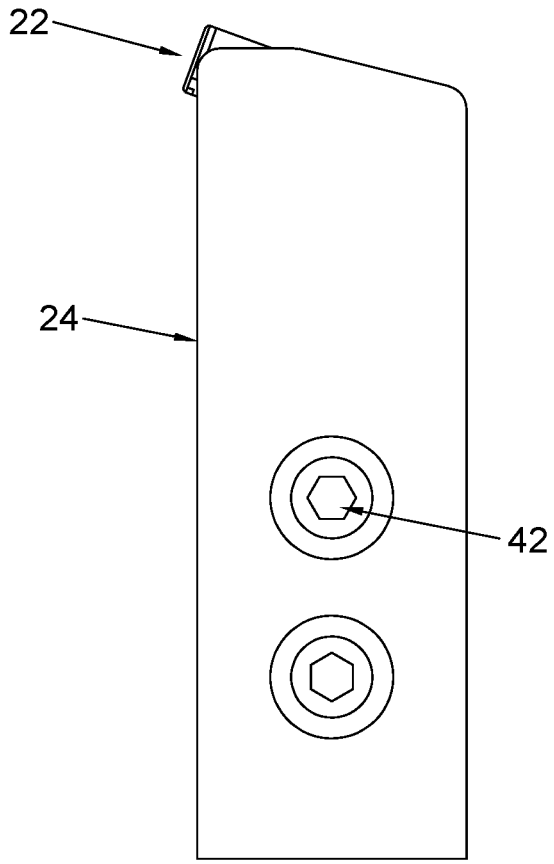
FIG. 12 is a side view of one of the tool holders with a cutting element of FIG. 7.

Optionally, the rake angle of the (PDC-type) cutting element is between 15 degrees and 30 degrees. Optionally, the rake angle is around 20 degrees. Optionally, the rake angle may be positive or negative. FIG. 12 shows how the cutting element 22 protrudes from the tool holder 24.

Figure 13:
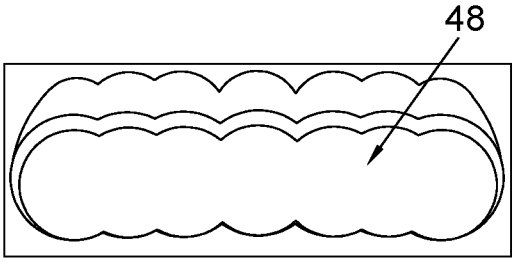
FIG. 13 is a computer simulated schematic of the rock cut by the disk cutter of FIG. 5.

In rock excavation applications, the disk cutter 18 is brought into contact with the rock formation 2 and rotation of the drive spindle 16, and therefore its disk cutter(s) 18, causes slicing of the rock formation 2. The cutting assembly 10 slices into the rock formation 2, for example, to create clean orthogonal cuts of around 16 mm, depending on the size of the cutting elements 22 selected. The cut rock breakouts either under its own weight or with secondary wedge force, e.g. using a wedge-shaped tool. The cutting elements 22 in each set produce an overlapping cut, indicated generally at 48, in the rock, as shown in FIG. 13. This evenly distributes the cutting force on the cutting slot.

The overlapping cut in the main embodiment is 60 mm, and this is based on four tool holder and cutting element combinations within each set. If a larger overlapping cut is required, more tool holder and cutting element combinations would be used, for example, six, eight, ten, twelve etc. If a smaller overlapping cut is required, less tool holder and cutting element combinations would be required, for example two or three.

Figure 14:
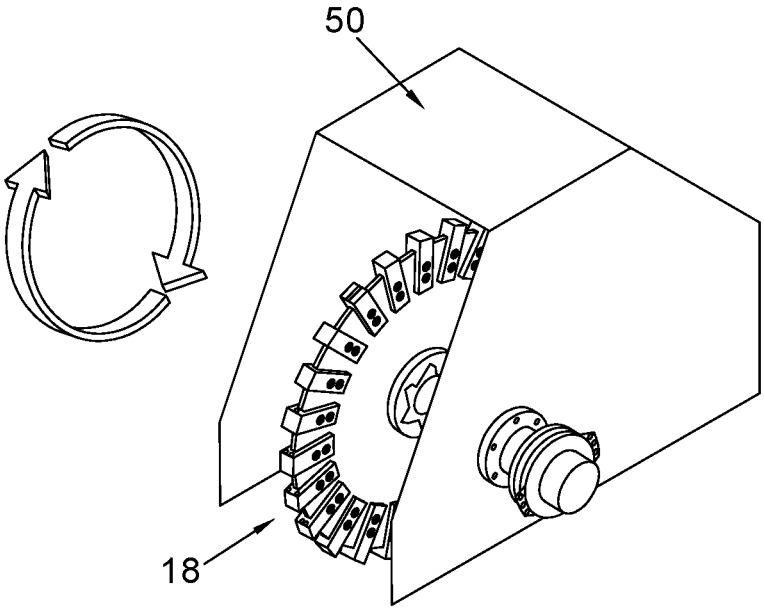
FIG. 14 is a perspective view of a trench cutter incorporating the disk cutter of FIG. 5.
Figure 15:
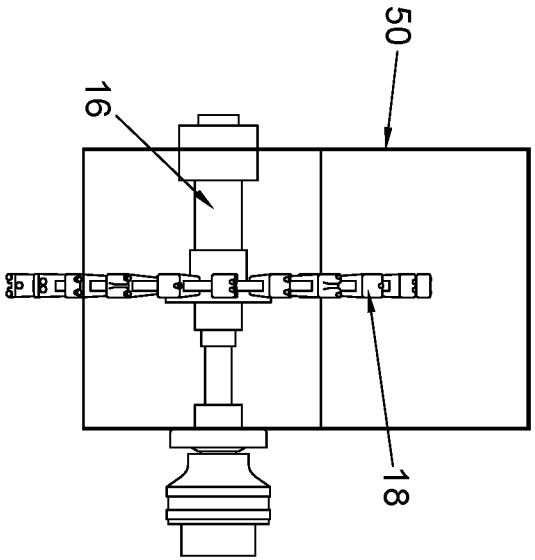
FIG. 15 is a top view of the trench cutter of FIG. 15.

Referring to FIGS. 14 and 15, trenching is a significant potential application of the cutting assembly and specifically of the disk cutter 18. Typically, a single disk cutter 18 is mounted about a drive spindle 16 and in use, is rotated in the direction indicated by the arrows. The disk cutter 18 and spindle are mounted and housed within a housing 50. When the disk cutter 18 is rotated and brought into contact with the ground, the disk cutter(s) 18, slices it.

A small-scale version could be used for digging micro trenches in roads and pavements, for example, for laying small diameter fibre optic cables. In this case, the cutting assembly 10 would be cutting into asphalt and concrete, not rock. In such an embodiment, the diameter of the cutter body 20 would be in the order of 300 mm, the lateral thickness of the cutter body up to 20 mm, and the cutting elements sized correspondingly. The intention is to achieve a depth of cut of around 50 mm to 100 mm.

For some trenching operations, the diameter of the cutter body would be around 1100 mm and the lateral thickness of the disk cutter (including cutting elements 22) would be around 60 mm.

Although several applications of the cutting assembly have been mentioned above, tunnelling is a particularly attractive application. Conventionally, in order to create a new tunnel underground, a tunnel boring machine (TBM) is used. TBMs create a cylindrical shaped tunnel in a well-known manner. If the purpose of the tunnel is for vehicular or pedestrianised traffic, and only a circular lateral cross-section is possible, a new horizontal floor must be included within the lower portion of the tunnel. Effectively, the diameter of the tunnel is oversized. Excess rock material must be extracted in order to create the actual required useable space within the upper portion of the tunnel and this increases tunnelling costs, not only because a larger TBM demands more consumable cutting tips than a smaller TBM, but also that the tunnelling operation takes significantly longer. Furthermore, additional material is required for construction of the new floor. Thanks to the cutting assembly described herein, a tunnel with a smaller lateral cross-section can be created, thereby producing the required shape of the upper tunnel. The cutting assembly then follows the smaller TBM to shape the lower half of the tunnel, creating a floor perpendicular to the walls, and removing significantly less material than with a larger TBM.

Figure 16:
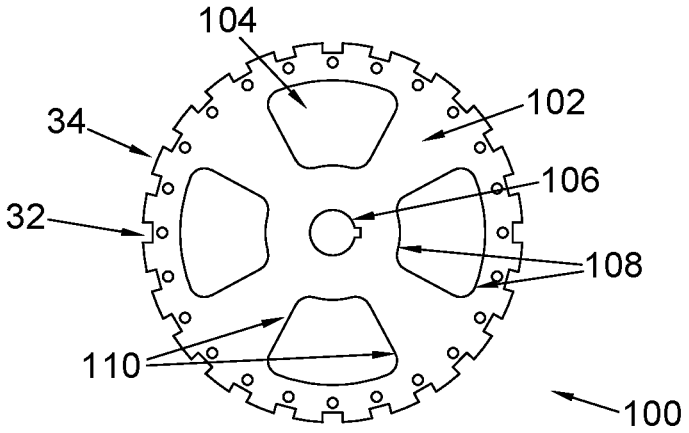
FIG. 16 is a side view of a second embodiment of the cutter body forming part of the disk cutter of FIG. 5.
Figure 17:
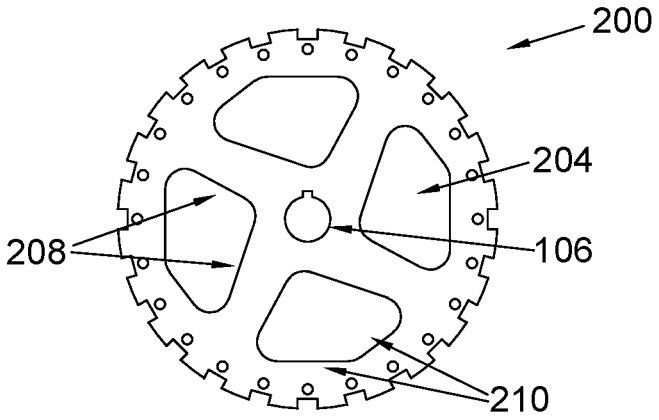
FIG. 17 is a side view of a third embodiment of the cutter body forming part of the disk cutter of FIG. 5.

The circular body 20 was previously indicated as being a solid disc with only a central (or off-set) shaft aperture for receiving the drive spindle 16. FIGS. 16 to 19 depict an alternative form of circular body 20, which could be used in any combination with of the features described herein. In FIGS. 16 and 17, four panels have been removed from the body to leave four apertures and similarly, in FIGS. 18 and 19, five panels have been removed. Typically, these panels are removed by laser, though any form of machining could be used. The pattern of the apertures maintains structural strength whilst reducing the weight of the whole disk. Optimised strength to weight ratios for different applications can be achieved with different geometric designs.

Referring to FIG. 16, a second embodiment of the cutter body is indicated at 100. The body comprises four radial spokes 102 and four light-weighting apertures 104, one aperture 104 between a pair of neighbouring spokes 102. The spokes 102 are regularly spaced apart and symmetrical about the central shaft aperture 106 that receives the drive spindle 16. The spokes 102 taper circumferentially outwardly from the centre of the body 100 towards the peripheral surface 34 of the body 100. As a consequence, each aperture 104 is generally trapezoidal in shape, with a pair of arcuate inner and outer surfaces 108 and a pair of straight surfaces 110 adjoining the arcuate surfaces 108. The arcuate surfaces 108 extend circumferentially, whereas the straight surfaces 110 extend radially.

In FIG. 17, a third embodiment of the cutter body is indicated at 200. The body comprises four radial spokes 202 and four light-weighting apertures 204, one aperture 204 between a pair of neighbouring spokes 202. The spokes 202 are regularly spaced apart about the central shaft aperture 106. However, the spokes 202 are off-set centrally and the body 200 is asymmetric about its axis of rotation, the shaft aperture 106. The breadth of the spokes 202 remains largely unchanged from the centre of the body 100 towards the peripheral surface 34 of the body 200. Each aperture 204 is a quadrilateral, with two adjoining surfaces 208 extending generally radially and an opposing pair of adjoining surfaces 210 extending generally circumferentially.

Figure 18:
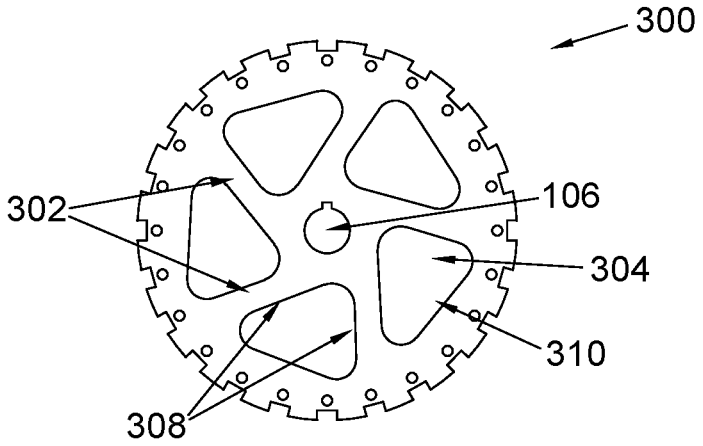
FIG. 18 is a side view of a fourth embodiment of the cutter body forming part of the disk cutter of FIG. 5.

In FIG. 18, a third embodiment of the cutter body is indicated at 300. The body comprises five radial spokes 302 and five light-weighting apertures 304, one aperture 304 between a pair of neighbouring spokes 302. The spokes 302 are regularly spaced apart about the central shaft aperture 106. However, the spokes 302 are off-set centrally and the body 300 is asymmetric about its axis of rotation, the shaft aperture 106. The breadth of the spokes 202 remains largely unchanged from the centre of the body 100 towards the peripheral surface 34 of the body 300. Each aperture 304 is triangular with rounded corners. Two surfaces 308 extend generally radially and a third surfaces 310 extends generally circumferentially.

Figure 19:
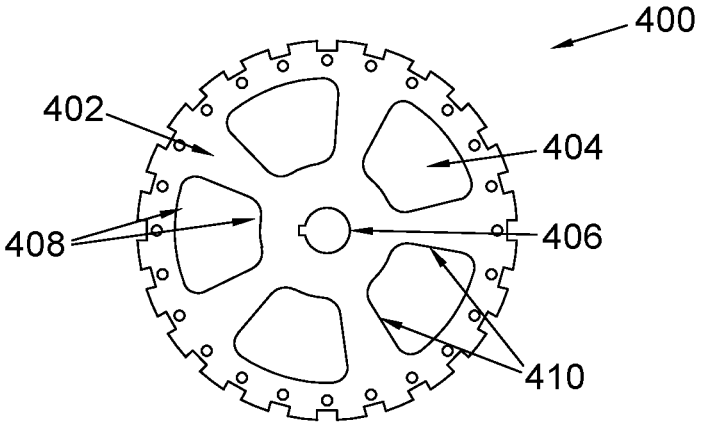
FIG. 19 is a side view of a fifth embodiment of the cutter body forming part of the disk cutter of FIG. 5.

Referring to FIG. 19, a fourth embodiment of the cutter body is indicated at 400. The body comprises five radial spokes 402 and five light-weighting apertures 404, one aperture 404 between a pair of neighbouring spokes 402. The spokes 402 are regularly spaced apart and symmetrical about the central shaft aperture 106 that receives the drive spindle 16. The spokes 402 taper circumferentially outwardly from the centre of the body 400 towards the peripheral surface 34 of the body 400. As such, each aperture 404 is generally trapezoidal in shape, with a pair of arcuate inner and outer surfaces 408 and a pair of straight surfaces 410 adjoining the arcuate surfaces 408. The arcuate surfaces 408 extend circumferentially, whereas the straight surfaces 410 extend radially.

While this invention has been particularly shown and described with reference to embodiments, it will be understood by those skilled in the art that various changes in form and detail may be made without departing from the scope of the invention as defined by the appended claims.

For example, any cutter body variant may be used in combination with any of the features disclosed herein.

Certain standard terms and concepts as used herein are briefly explained below.

As used herein, polycrystalline diamond (PCD) material comprises a plurality of diamond grains, a substantial number of which are directly inter-bonded with each other and in which the content of the diamond is at least about 80 volume percent of the material. Interstices between the diamond grains may be substantially empty or they may be at least partly filled with a bulk filler material or they may be substantially empty. The bulk filler material may comprise sinter promotion material.

The invention claimed is:

1. A disk cutter comprising:

a cutter body, a plurality of tool holders and a plurality of cutting elements mounted to the tool holders, wherein two or more cutting elements are mounted in one or more of the tool holders, wherein the tool holders and cutting elements are provided in at least one set about the cutter body, each set comprising two or more tool holders and two or more cutting elements arranged in a pre-determined sequence of configurations, and wherein within each set a lateral spacing between said two or more cutting elements on each tool holder varies according to the tool holder's position within the predetermined sequence of configurations.

2. The disk cutter as claimed in claim 1, comprising multiple sets around a circumferential surface of the cutter body.

3. The disk cutter as claimed in claim 2, in which the multiple sets are identical.

4. The disk cutter as claimed in claim 2, in which the multiple sets are non-identical.

5. The disk cutter as claimed in claim 1, comprising three or more tool holders in a set.

6. The disk cutter as claimed in claim 1, comprising four tool holders in a set.

7. The disk cutter as claimed in claim 1, comprising a single cutting element in one or more of the tool holders.

8. The disk cutter as claimed in claim 7, in which the single cutting element is mounted centrally on the tool holder.

9. The disk cutter as claimed in claim 1, in which the two cutting elements are arranged spaced apart with a recessed channel in between then.

10. The disk cutter as claimed in claim 1, in which the cutting element is a polycrystalline diamond compact (PDC).

11. The disk cutter as claimed in claim 10, in which the PDC has a triple chamfer.

12. The disk cutter as claimed in claim 1, in which the cutter body comprises a series of slots.

13. The disk cutter as claimed in claim 1, in which the tool holder comprises a body portion and a pair of spaced apart legs.

14. The disk cutter as claimed in claim 13, in which the tool holder tapers inwardly from a first end, proximate the or each cutting element towards a second end.

15. A trench cutter comprising a disk cutter as claimed in claim 1.

16. The trench cutter of claim 15, in which the cutter body has a diameter in the range of 900 to 1200 mm.

17. The trench cutter of claim 15, in which the cutter body has a thickness in the range of 20 to 30 mm.

18. The trench cutter of claim 15, in which the disk cutter has a cutting width of 60 mm.

* * * * *